US005197199A

United States Patent [19]

Shrader

[11] Patent Number: 5,197,199

[45] Date of Patent: Mar. 30, 1993

[54] REFLECTED SPOT SUNDIAL

[76] Inventor: William W. Shrader, 144 Harvard Rd., Stow, Mass. 01775-1070

[21] Appl. No.: 831,973

[22] Filed: Feb. 6, 1992

[51] Int. Cl.[5] ..... G04B 49/02

[52] U.S. Cl. ..... 33/270; 33/269

[58] Field of Search ..... 33/268, 269, 270

[56] References Cited

U.S. PATENT DOCUMENTS

| | | | |
|---|---|---|---|
| 89,585 | 5/1869 | Johnson | 33/270 |
| 165,746 | 7/1875 | McCoy | 33/270 |
| 1,289,837 | 12/1918 | Love | 33/270 |
| 4,346,521 | 8/1982 | Luft | 33/269 |
| 4,373,270 | 2/1983 | Ousley | 33/270 |
| 4,384,408 | 5/1983 | Bohlayer | 33/270 |
| 4,520,572 | 6/1985 | Spilhaus | 33/270 |
| 4,835,875 | 6/1989 | Fuller | 33/270 |
| 4,945,644 | 8/1990 | Fuller | 33/269 |

FOREIGN PATENT DOCUMENTS

| | | | |
|---|---|---|---|
| 2467427 | 5/1981 | France | 33/269 |
| 20274 | 8/1902 | United Kingdom | 33/269 |
| 14858 | 12/1915 | United Kingdom | 33/269 |

*Primary Examiner*—Thomas B. Will

[57] ABSTRACT

A sundial is described using a mirror to reflect an indexing spot of sunlight onto the back of a translucent dial face that is marked with time and date indicia. Adjustments are provided so that a sundial designed for any location can be used in another location and still provide accurate zone time and date.

10 Claims, 3 Drawing Sheets

REFLECTED SPOT SUNDIAL

FIELD OF THE INVENTION

The field of the invention relates to sundials, and more particularly to a new type of sundial that uses a mirror to reflect a spot of sunlight on the back of a translucent face to indicate accurate time and date.

DESCRIPTION OF THE PRIOR ART

Sundials have been used throughout the ages for indication of time of day. The most common type of sundial is a flat plate parallel to the earth's surface and a gnomon aligned with the earth's axis of rotation. Sundials have been implemented in many manifestations. They have included cylindrical faces (U.S. Pat. No. 3,417,473 Troseth, 1968), spherical faces (U.S. Pat. No. 1,651,621 O'Sullivan, 1925), translucent faces wherein a sunbeam enters a hole in the top of the dial and casts a spot onto the back of the face (U.S. Pat. Nos. 89,585 Johnson, 1869, and 4,384,408 Bohlayer), translucent faces wherein a shadow of a gnomon casts a line on the back of a translucent face (U.S. Pat. No. 783,245 Clarke, 1905), and mirrors with a non-reflecting line to cast a line onto the dial face (U.S. Pat. No. 3,786,570 Davies, 1974). Sundials have been designed with time indicia in the shape of analemmas (U.S. Pat. Nos. 794,7B7 Crehore, 1905 and 4,384,408 Bohlayer), and sundials have been designed that indicate the date (U.S. Pat. Nos. 794,787 and 4,384,408). Sundials have been designed with installation indicia and adjustment means (U.S. Pat. No. 4,924,592 Fuller, 1990). This invention differs from prior art in that it uses a mirror to reflect the sun's ray as a spot onto the back of a translucent face. The nature of the device is such that with precise manufacture and installation of the sundial, accurate time and date will be displayed throughout the year. The functional advantage over prior art (U.S. Pat. Nos. 89,585 and 4,384,408) is that the face of the dial is positioned for easy reading and a further advantage is that the dial may be considered more aesthetically pleasing.

SUMMARY OF THE INVENTION

The present invention is a sundial that uses a small mirror to reflect the sun's beam as a spot onto the back of a translucent face that is marked with time and date indicia. Because the back of the sundial faces South (in the northern hemisphere), the dial can be used indoors where sun enters a window With built-in adjustment apparatus, or when used with an asymmetrical wedge-shaped base, the dial can be adjusted to indicate accurate zone time and date at any location. The time indicia are analemmas corresponding to the equation of time. The date indicia correspond to the changing declination of the sun throughout the year. The dial is thus instructive and educational for it reveals the ever-changing aspect of the sun's motion through the sky.

DESCRIPTION OF THE PREFERRED EMBODIMENT

Figure 1:
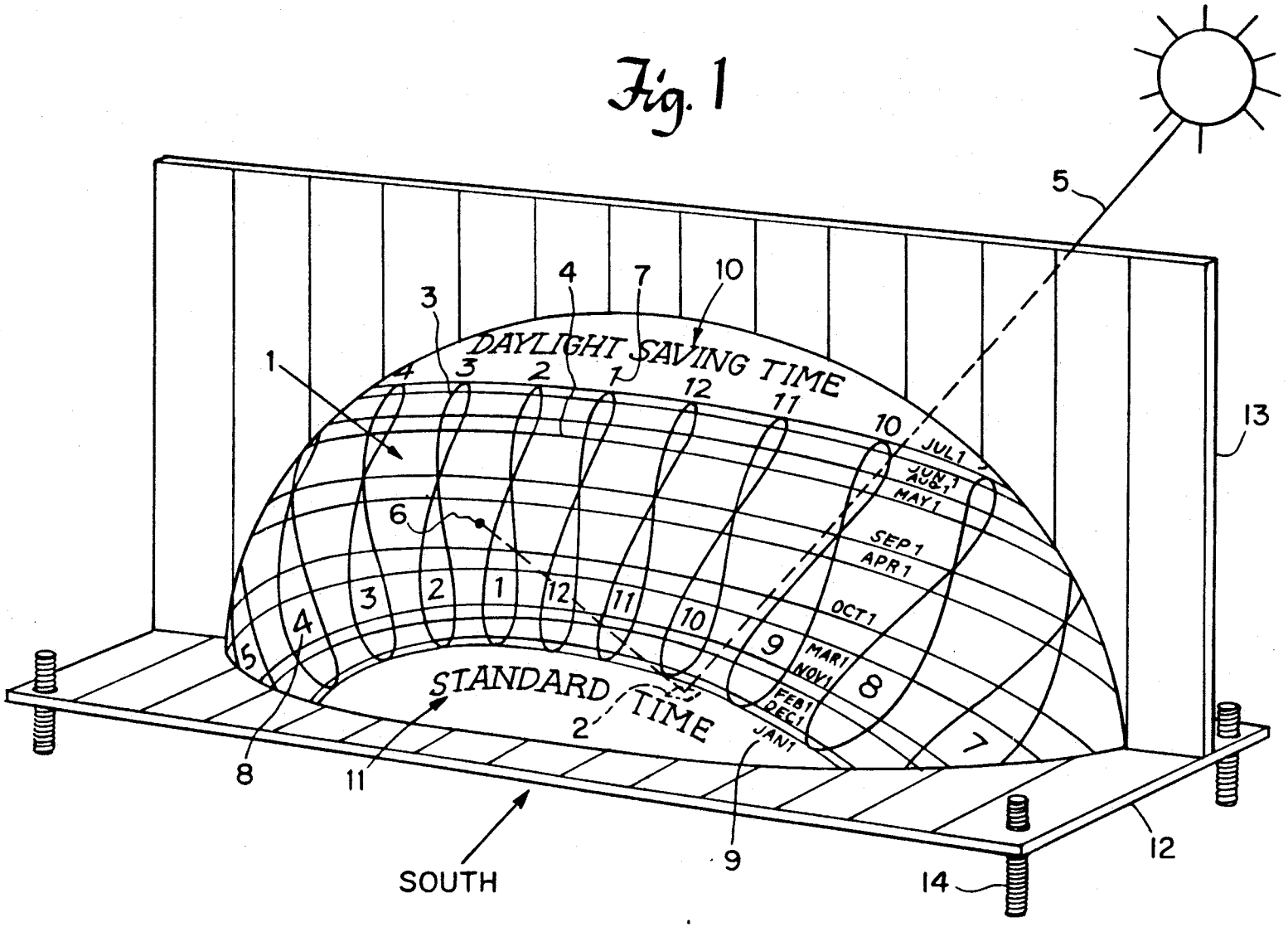
FIG. 1 is the front view of the preferred embodiment of the present invention.

FIG. 1 shows a front view of the preferred embodiment of the invention. The present invention consists of a translucent dial face 1 and a mirror 2. The dial face is a section of an ellipsoid. The preferred mirror type is a first-surface mirror which creates a better defined spot than a second-surface mirror. On the dial face are inscribed time indicia of which 3 is one and date indicia of which 4 is one. The back of the dial faces south. The sun's ray 5 strikes the mirror 2 and is reflected to the back of the face 1 and forms a dot 6. The position of the dot, visible through the translucent face, indicates accurate time and also indicates the date. The time indicia are in the shape of analemmas, thus providing accurate time throughout the year. The date indicia are generally horizontal lines related to the declination of the sun. The indicated time and date may be either of two values, depending whether the dial is being used in the six months preceding the winter solstice, or being used in the six months following the winter solstice. Color coding is used in the preferred embodiment, with red lines used for the time and date indicia for the summer and fall months, and blue lines for the time and date indicia for the winter and spring months. The time indicia are labeled with numbers of which 7 is one indicating daylight saving time and are further labeled with numbers of which 8 is one indicating standard time. The date indicia are labeled with dates of which 9 is one indicating the first day of each month.

In the preferred embodiment of the invention, the time indicia are marked with daylight saving time near the top when the sun's declination is greatest (spring and summer) and the time indicia are marked with standard time near the bottom when the sun's declination is least (fall and winter). The design of this dial is such that time can be determined within fractions of a minute, and dates can be determined within a day or so whenever the reflected sun's ray falls on the respective indicia. The phrase "DAYLIGHT SAVING TIME" 10 and the numbers indicating daylight saving time are red in the preferred embodiment of the invention. The phrase "STANDARD TIME" 11 and the numbers indicating standard time are blue in the preferred embodiment of the invention.

The preferred embodiment of the invention has a base plate 12 and a back plate 13. In the base plate are adjustment means of which 14 is one so that the dial may be adjusted for locations other than that for which it was designed, and also can be adjusted for use on surfaces that are not level. The adjustment means in the base of the preferred embodiment are legs implemented with threaded screws to provide precise adjustments.

Figure 2:
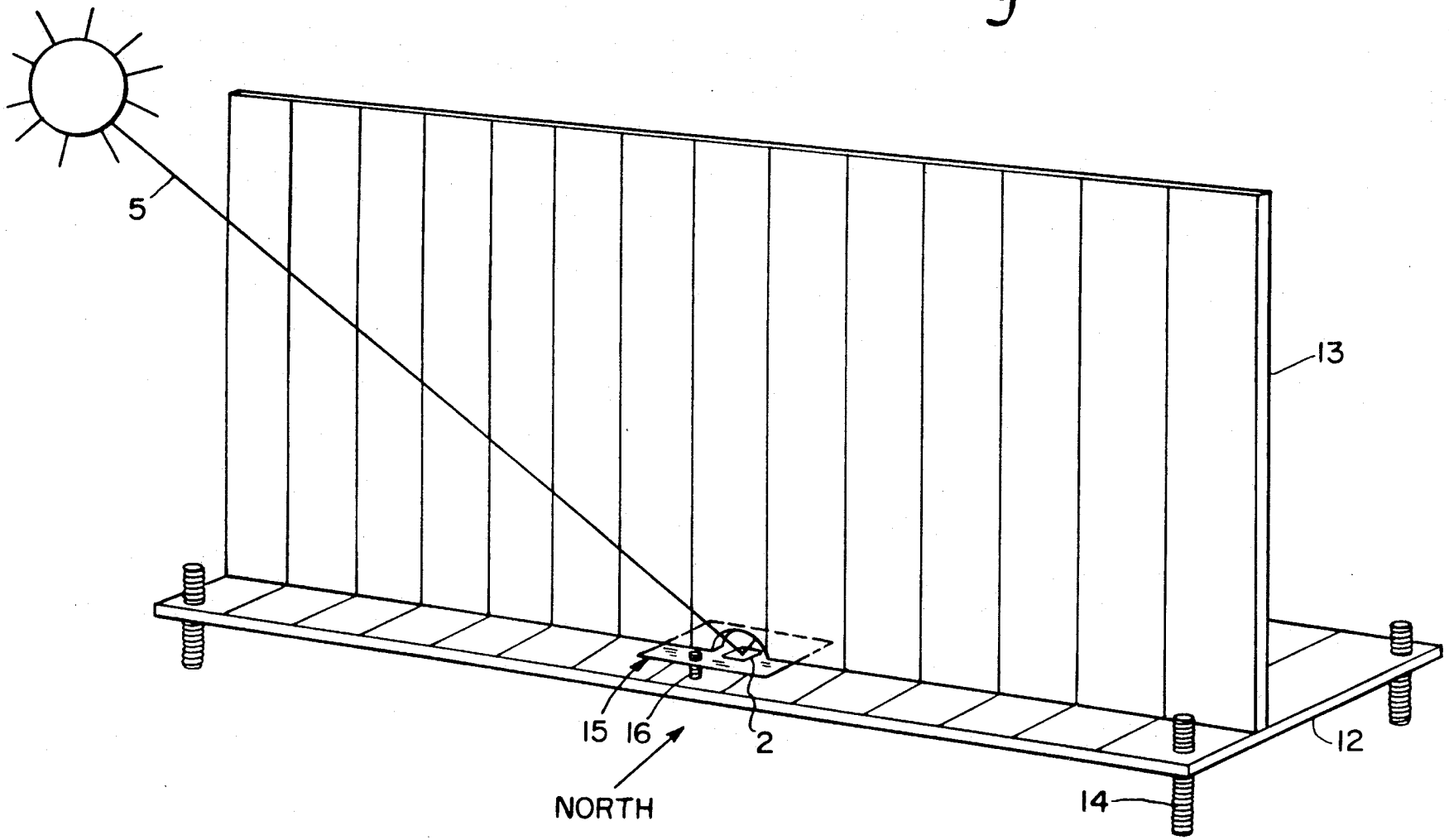
FIG. 2 is the back view of the preferred embodiment of the present invention showing the mirror adjustment means.

Refer now to FIG. 2 which is a back view of the preferred embodiment of the invention. The mirror 2 is located on a mirror mounting apparatus 15 with adjustment means 16 so that the mirror can be tilted to compensate for different latitudes at which the dial may be used without the need for tilting the base. The mirror mounting apparatus is configured so that tilting the mirror does not change the location of the center of the mirror. Further, a mirror that can be tilted allows positioning the time and date indicia on the dial face in the most artistic manner. The preferred embodiment is designed so that mirror tilt is about 5 degrees towards north for a dial to be used at 35 degrees north latitude. It should be noted that once the time indicia are drawn on the dial face, tilting the mirror cannot be used for longitude adjustment. As is well known to one skilled in the mathematics of coordinate transformations, attempting to tilt the mirror for longitude adjustment would require repositioning the indicia on the dial face. However, the indicia can be correctly calculated for tilt of the mirror in any direction.

The position of the indicia on the dial face are calculable from the equation of time, the sun's declination, the latitude and longitude for which the dial is designed, the dimensions of the dial, the shape of the face, and the tilt of the mirror. The formulas for the equation of time and declination of the sun can be obtained from many computer programs. (Reference: *Astronomy With Your Personal Computer,* Peter Duffett-Smith, Cambridge University Press, New York, N.Y., 1985, or "Sky and Telescope", July, 1982, p. 88). The transformations necessary to calculate the position of the lines for any combination of latitude, longitude, mirror tilt, and shape and position of the dial face can be obtained from many mathematical textbooks. (e.g., *Handbook of Mathematical Tables and Formulas, 3d Edition,* R. S. Burington, Handbook Publishers, Inc, Sandusky, Ohio, 1949)

The back plate 13 is opaque so that sunlight will not impinge on the back of the dial face, thus increasing the contrast between the reflected spot of sunlight and the surrounding area.

Figure 3:
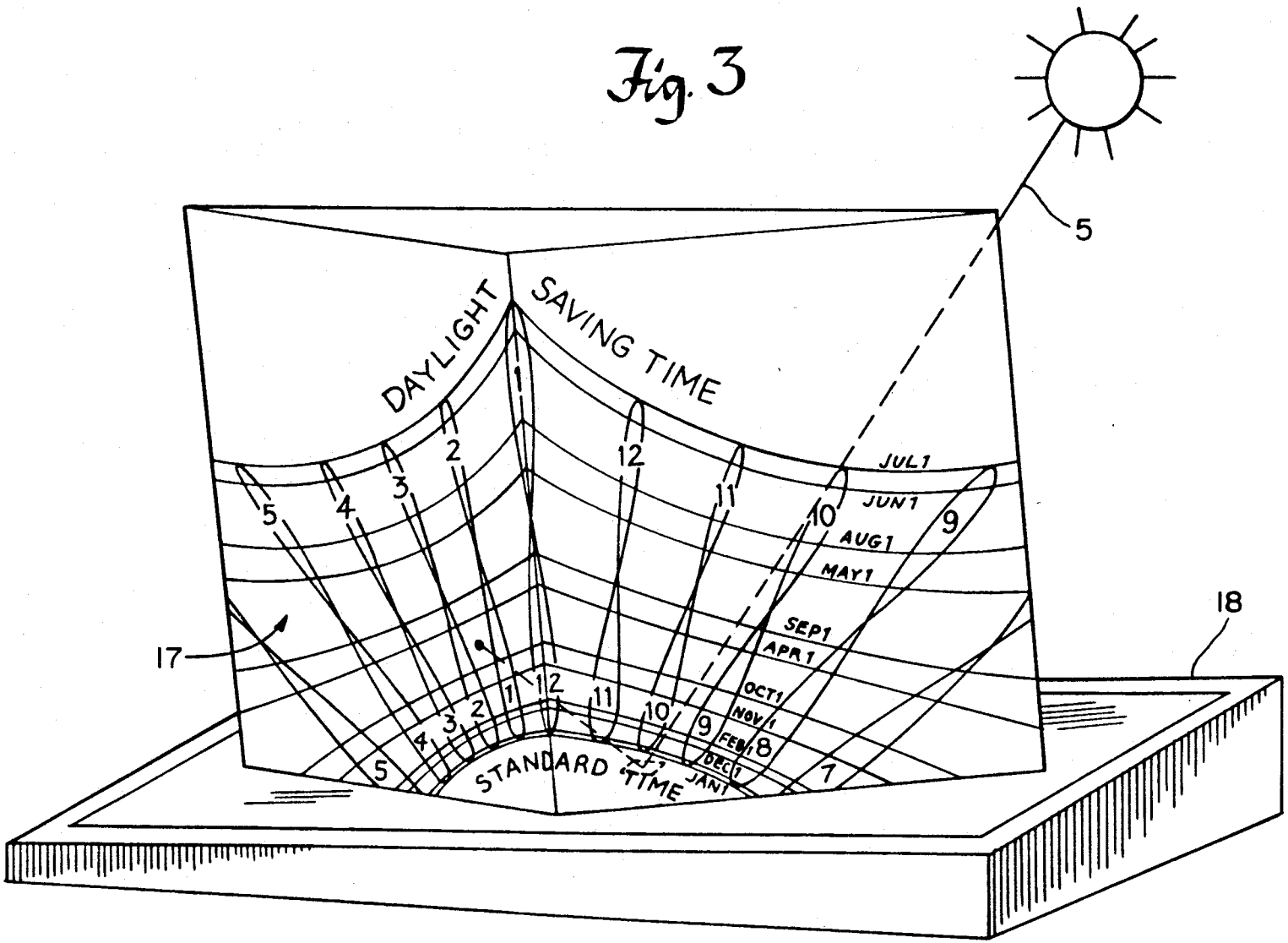
FIG. 3 is a front view of an alternative embodiment of the present invention and it also shows an asymmetrical wedge-shaped base.

FIG. 3 shows an alternate embodiment of the invention in which the dial face 17 comprises flat plates. The base adjustment means is an asymmetrical wedge-shaped base 18 that can be used to customize the dial for use at a location other than the location for which the dial was specifically designed, or be used to compensate for a non-level surface.

The dial may be designed for a particular location (latitude and longitude). or it may be a general design that can be used at any latitude and longitude by using the adjustment means of the mirror 15, the legs 14, the wedge 18, or any combination thereof.

Having described two embodiments of the invention, it will now be apparent to one of skill in the art that other embodiments incorporating its concepts may be implemented. For example, the face of the dial may be comprised of either a section of an ellipsoid, or a section of a sphere, or a section of a cylinder, or flat plates, or any other functional configuration. Further, the time indicia on the dial can be marked for either standard time, daylight saving time, or both. A dial marked for standard time can be adjusted to read precisely and correctly for daylight saving time by means of the adjustment means. Further, a dial can be designed for use in the southern hemisphere so that the back of the dial faces north. Further, the dial can be designed for any specific latitude and longitude. Further, the mirror may be positioned horizontally, or tilted in any direction. Tilting the mirror allows the indicia on the face to be repositioned, which may be more pleasing at some latitudes, or may be more pleasing for different orientations of the sundial. Further, the dial can be designed so that it is asymmetrical. This would be useful for a dial designed to sit on a window sill that does not face due South. It is felt, therefore, that this invention should not be restricted to the disclosed embodiments, but rather should be limited only by the spirit and scope of the appended claims.

I claim:

1. A sundial comprising:

(a) a translucent dial face having a front and back with time indicia, in said dial face placed to have the back of the dial face positioned toward the sun; and (b) means placed behind said translucent dial face for reflecting a sun beam received from the sun in back of said sundial as a spot onto the back of said translucent dial face so that time can be ascertained by observing on the front of said translucent dial face the location of said reflected spot with respect to lines of said time indicia.

2. The sundial as set forth in claim 1 further comprising date indicia disposed on said translucent dial face.

3. The sundial as set forth in claim 1 further comprising a baseplate to support said dial face and said reflecting means and positioined in a horizontal plane to facilitate positioning said sundial, and a back plate positioned in a vertical plane perpendicular to said baseplate behind said dial face to prevent excess sunlight from shining on said translucent dial face.

4. The sundial as set forth in claim 3 wherein said baseplate comprises adjustment means to compensate for different locations where said sundial may be used and to compensate for non-level surfaces on which said sundial may be placed.

5. The sundial as set forth in claim 4 wherein said adjustment means comprises adjustable legs coupled to said baseplate to tilt said sundial.

6. The sundial as set forth in claim 4 wherein said adjustment means comprises an asymmetrical wedge-shaped base.

7. The sundial as set forth in claim 3 wherein said reflecting means supported by said baseplate comprises means for tilting said reflecting means to permit using said sundial at different latitudes.

8. The sundial as set forth in claim 7 wherein said baseplate comprises adjustment means for tilting said baseplate of said sundial.

9. The sundial as set forth in claim 1 wherein said translucent dial face comprises a section of an ellipsoid.

10. The sundial as set forth in claim 1 wherein said translucent dial face comprises a wedge shape.

* * * * *

UNITED STATES PATENT AND TRADEMARK OFFICE

CERTIFICATE OF CORRECTION

PATENT NO. : 5,197,199

DATED : March 30, 1993

INVENTOR(S) : William W. Shrader

It is certified that error appears in the above-indentified patent and that said Letters Patent is hereby corrected as shown below:

Col. 4, line 13 & 14, should read (a) a translucent dial face having a front and a back with time indicia, in use said dial face placed to..."

Signed and Sealed this

Twenty-third Day of November, 1993

*Attest:*

*Attesting Officer*

BRUCE LEHMAN

*Commissioner of Patents and Trademarks*